US008495796B2

(12) United States Patent
Ohashi et al.

(10) Patent No.: US 8,495,796 B2
(45) Date of Patent: Jul. 30, 2013

(54) OPENING-AND-CLOSING MECHANISM AND LATCHING MECHANISM

(75) Inventors: Naoki Ohashi, Shizuoka (JP); Tetsuya Abe, Iwata (JP)

(73) Assignee: Beckman Coulter, Inc., Brea, CA (US)

( * ) Notice: Subject to any disclaimer, the term of this patent is extended or adjusted under 35 U.S.C. 154(b) by 907 days.

(21) Appl. No.: 11/997,483

(22) PCT Filed: Aug. 3, 2006

(86) PCT No.: PCT/JP2006/315402

§ 371 (c)(1),
(2), (4) Date: Aug. 5, 2010

(87) PCT Pub. No.: WO2007/015544

PCT Pub. Date: Feb. 8, 2007

(65) Prior Publication Data

US 2010/0293749 A1 Nov. 25, 2010

(30) Foreign Application Priority Data

Aug. 4, 2005 (JP) ..... 2005-226932
Jun. 2, 2006 (JP) ..... 2006-154637

(51) Int. Cl.
*E05D 11/10* (2006.01)

(52) U.S. Cl.
USPC ..... 16/334

(58) Field of Classification Search
USPC ..... 16/327–334, 300, 315, 344, 284, 16/DIG. 33, 85, 321, 362, 363; 49/8
See application file for complete search history.

(56) References Cited

U.S. PATENT DOCUMENTS

| | | | | |
|---|---|---|---|---|
| 4,718,127 | A * | 1/1988 | Rittmann et al. | 2/424 |
| 6,092,334 | A * | 7/2000 | Kim | 49/8 |
| 6,115,886 | A | 9/2000 | Fujita | |
| 6,457,207 | B1 * | 10/2002 | Horberg | 16/50 |
| 7,461,432 | B2 * | 12/2008 | Lowen et al. | 16/334 |
| 2007/0050940 | A1 * | 3/2007 | Lowen et al. | 16/334 |

FOREIGN PATENT DOCUMENTS

| | | |
|---|---|---|
| JP | 7-1250 | 1/1995 |
| JP | HEI-8-46369 | 2/1996 |
| JP | 11-6519 | 1/1999 |
| JP | 11-6520 | 1/1999 |
| JP | 2003-56547 | 2/2003 |
| JP | 2006-105275 | 4/2006 |

* cited by examiner

*Primary Examiner* — Victor Batson
*Assistant Examiner* — Matthew Sullivan
(74) *Attorney, Agent, or Firm* — Kilpatrick Townsend & Stockton LLP

(57) ABSTRACT

Provided is an opening-and-closing mechanism that can be latched at a predetermined opening angle, wherein the latching can be disengaged with a small force in the opening direction whereas the latching is gradually disengaged in the closing direction. An opening-and-closing mechanism includes first and second supporting members disposed relatively rotatable around a rotary axis; a plurality of protruding portions provided on the first supporting member; and a plurality of depressed portions provided on the second supporting member and engaged with the plurality of protruding portions, wherein, when the first and second supporting members are in a plurality of predetermined relative alignments, some of the plurality of protruding portions and some of the plurality of depressed portions are engaged, and wherein forces required for disengaging the protruding portions and the depressed portions by rotating at least one of the first and second supporting members differ first and second rotation directions.

13 Claims, 15 Drawing Sheets

OPENING-AND-CLOSING MECHANISM AND LATCHING MECHANISM

TECHNICAL FIELD

The present invention relates to an opening-and-closing mechanism and a latching mechanism.

BACKGROUND ART

In general, rotary covers for opening and closing pianos, notebook computers, and office appliance, such as copy machines, and opening-and-closing covers of refrigerated compartments for reagents and analyzers, such as DNA analyzers and antibody detectors, are provided such that one end of the cover is supported by a rotary shaft and the other end is rotatable in the vertical direction.

However, when the above-described type of covers is to be closed, the weight of the cover itself is exerted in the closing direction, causing the cover to tend to slam shut. When the cover is slammed shut, the cover and the main body may be damaged by the shock from closing the cover. In particular, a heavy cover tends to slam shut, causing damage, namely, breaking the cover.

Accordingly, to prevent such damage, various techniques have been proposed to prevent the cover from slamming shut (for example, refer to Patent Document 1).

Patent Document 1: Japanese Unexamined Patent Application, Publication No. HEI-8-46369 (p. 3, FIG. 1)

DISCLOSURE OF INVENTION

Patent Document 1, described above, discloses a cover opening-and-closing mechanism that includes a stopper portion having a protruding portion on one of a cover and a main body and a depressed portion, on which the protruding portion of the stopper portion is latched, on the other one of the cover and the main body at a set opening angle of the cover.

However, with the above-described cover opening-and-closing mechanism, to disengage the protruding portion and the depressed portion, forces of the same magnitude are required in both the opening and closing directions of the cover.

In particular, there is a problem in that, when the cover is heavy, a force is required to open the cover from a state in which the protruding portion and the depressed portion are latched. In contrast, there is a problem in that, to close the cover from a state in which the protruding portion and the depressed portion are latched, the cover tends to slam shut because of both the disengaging force and gravity acting upon the cover. There is also a problem in that, when the cover is slammed shut, damage is caused to the cover or the main body.

Not only with a cover that is opened and closed vertically, but also with a member, such as a door or a sliding door, that is rotated or translated in the horizontal direction, it is required that the cover or member does not easily open in one direction and slam shut in the opposite direction.

The present invention has been conceived in light of the problems described above. Accordingly, it is an object of the present invention to provide an opening-and-closing mechanism that can be latched at a predetermined opening angle wherein the latching can be disengaged with a small force in the opening direction whereas the latching is gradually disengaged in the closing direction.

The present invention has been conceived in light of the problems described above. Accordingly, it is another object of the present invention to provide a latching mechanism that has a simple structure and that is capable of having different latching forces for two members, moving relative to each other, depending on the relative movement direction.

To achieve the above-described objects, the present invention provides the following solutions.

A first aspect of the present invention provides an opening-and-closing mechanism including: a first supporting member and a second supporting member disposed so as to be capable of relative rotation around a rotary axis; a plurality of protruding portions provided on the first supporting member; and a plurality of depressed portions provided on the second supporting member and engaged with the plurality of protruding portions, wherein, when the first supporting member and the second supporting member are in a plurality of predetermined relative alignments, some of the plurality of protruding portions and some of the plurality of depressed portions are engaged, and wherein forces required for disengaging the protruding portions and the depressed portions by rotating at least one of the first supporting member and second supporting member differ in a first rotation direction and a second rotation direction.

According to the first aspect of the present invention, a plurality of protruding portions and a plurality of depressed portions are provided, and by selecting the combination of protruding portions and depressed portions to be engaged, the first supporting member and the second supporting member can be held in a plurality of predetermined relative alignments.

Moreover, since the first supporting member and the second supporting member are held in a plurality of predetermined relative alignments, even when the first supporting member and the second supporting member are released, the first supporting member and the second supporting member are held in another adjacent predetermined relative alignment. Therefore, the first supporting member and the second supporting member can be prevented from slamming shut.

According to the above-described opening-and-closing mechanism, the force required for disengagement differs when the protruding portions and the depressed portions are disengaged in a first rotating direction and when disengaged in a second rotating direction. Therefore, for example, the force required for rotating the first supporting member and the second supporting member in the opening direction can be set smaller than the force required for rotating in the closing direction.

In the above-described aspect, it is preferable to form the depressed portions as arcs, extending in the circumferential direction centered at the rotary axis, and to set the positions and the lengths an the circumferential direction of the depressed portions so that the number of protruding portions and depressed portions that are simultaneously disengaged differs depending on the relative rotating direction.

According to this structure, the depressed portions are formed as arcs, extending in the circumferential direction centered at the rotary axis, and the positions and the lengths in the circumferential direction of the depressed portions are set so that the number of protruding portions and depressed portions that are simultaneously disengaged differs depending on the relative rotating direction. Therefore, the force required for releasing the first supporting member and the second supporting member in a predetermined alignment in the first rotating direction can differ from the force required for releasing in the second rotating direction.

Since the number of protruding portions and depressed portions simultaneously disengaged is set to a predetermined number, the engaged protruding portions and the depressed portions that hold the first supporting member and the second supporting member in a predetermined alignment are not all simultaneously disengaged.

In other words, the number of protruding portions and depressed portions that are engaged is decreased as the relative alignment of the first supporting member and the second supporting member deviates from the predetermined relative alignment. Therefore, the magnitude of the force holding the first supporting member and the second supporting member in the predetermined relative alignment decreases as the relative alignment deviates from the predetermined relative alignment.

In the above-described aspect, it is preferable that the depressed portions extend in the circumferential direction centered at the rotary axis, and the widths in the radial direction differ at both ends in the circumferential direction.

According to this structure, since the widths in the radial direction of the depressed portions differ at both ends in the circumferential direction, the force required for disengaging the protruding portions and the depressed portions in the first rotating direction and the force required for disengaging the protruding portions and the depressed portions in the second rotating direction may differ. More specifically, the force required for disengaging the protruding portions and the depressed portions at the wide end portions in the radial direction is greater than the force required for disengaging the protruding portions and the depressed portions at the narrow end portions in the radial direction.

In the above-described aspect, it is preferable that the depths of the depressed portions differ at both ends in the circumferential direction centered at the rotary axis.

According to this structure, since the depths of the depressed portions differ at both ends in the circumferential direction, the force required for disengaging the protruding portions and the depressed portions in the first rotating direction and the force required for disengaging the protruding portions and the depressed portions in the second rotating direction may differ. More specifically, the force required for disengaging the protruding portions and the depressed portions at the end portions at the deeper side is greater than the force required for disengaging the protruding portions and the depressed portions at the end portions at the shallower side.

At the end portions at the shallower side, a member on which the depressed portions are provided may be formed such that the front surface and the bottom surface of the member are smoothly connected. By forming the surfaces in this way, the protruding portions and the depressed portions can be smoothly disengaged, and the force required for disengagement can be reduced.

In the above-described aspect, it is preferable that a connecting member for connecting the first supporting member and the second supporting member in a rotatable manner around the rotary axis be provided and that a pushing force acting upon a contact section of the first supporting member and the second supporting member be controlled by the connecting member.

According to this structure, since the connecting member controls the pushing force acting upon the contact section of the first supporting member and the second supporting member, the friction force acting between the first supporting member and the second supporting member can be controlled. Therefore, the force required when the first supporting member and the second supporting member are relatively rotated can be controlled.

In the above-described aspect, it is preferable that a sliding member for controlling a coefficient of friction between the first supporting member and the second supporting member be provided.

According to this structure, since the sliding member is provided between the first supporting member and the second supporting member, the coefficient of friction between the first supporting member and the second supporting member can be controlled. Therefore, the force required for relatively rotating the first supporting member and the second supporting member can be controlled.

In the above-described aspect, it is preferable that a stopper portion for limiting the range of relative alignment adopted by the first supporting member and the second supporting member be provided, the stopper portion being provided on at least one of the first supporting member and the second supporting member.

According to this structure, since the stopper portion is provided on at least one of the first supporting member and the second supporting member, the range of relative alignment adopted by the first supporting member and the second supporting member can be limited. Therefore, when a cover is provided on one of the first supporting member and the second supporting member, the cover can be prevented from opening too much by the stopper portion.

A second aspect of the present invention provides a latching mechanism which is interposed between a first member and a second member that are moved relatively and which latches the relative movement of the first member and the second member, the latching mechanism including: a plurality of protruding portions provided on the first member; and a plurality of depressed portions provided on the second member and engaged with the protruding portions, wherein a force required for disengaging the protruding portions and the depressed portions differs depending on the relative movement direction.

According to this aspect, by engaging the plurality of protruding portions provided on the first member and the plurality of depressed portions provided on the second member, the first member and the second member are latched to each other. By disengaging the protruding portions and the depressed portions, the first member and the second member can be relatively moved. In such a case, since the forces required for disengaging the protruding portions and the depressed portions differ depending on the relative movement direction, the above-described aspect is preferable for use when it is desirable to have different latching forces depending on the relative movement direction or is preferable for, for example, an opening-and-closing mechanism that includes heavy covers or doors or sliding doors that require a large latching force only in the closing direction or the opening direction.

In the above-described aspect, a plurality of sets of depressed portions comprising a plurality of depressed portions that may be simultaneously engaged with the plurality of protruding portions are provided in the relative movement direction of the first member and the second member, with spaces provided between the sets.

In such a structure, a plurality of protruding portions can be engaged with and latched to a set of depressed portions a plurality of times while the first member and the second member are relatively moved in one direction.

In the above-described aspect, it is preferable that the depressed portions extend in the relative movement direction of the first member and the second member, and the positions and lengths of the depressed portions be set such that the number of protruding portions and depressed portions simultaneously disengaged differs depending on the relative movement direction.

According to this structure, since the number of engaged protruding portions and depressed portions to be simultaneously disengaged differs when the first member and the second member are relatively moved in one direction and when the first member and the second member are relatively moved in another direction, from a state when a plurality of protruding portions and a plurality of depressed portions are engaged with each other, the latching force when the number of engaged portions is small can be set smaller than the latching force in which the number of engaged portions is large. In this way, a latching mechanism that has different latching forces depending on the relative movement direction can be easily configured.

In the above-described aspect, the depressed portions may extend in the relative movement direction of the first member and the second member, and wherein the widths of the depressed portion in a direction intersecting with the relative movement direction may differ at both ends in the relative movement direction.

According to this structure, the direction in which the depth of the engagement of the protruding portions and the depressed portions changes differs when the first member and the second member are relatively moved in one direction and when the first member and the second member are relatively moved in another direction, from a state in which a plurality of protruding portions and a plurality of depressed portions are engaged with each other. Therefore, when the first member and the second member are relatively move in the direction in which the width gradually increases, the protruding portions and the depressed portions are deeply engaged, and a relatively large force is required when the protruding portions and the depressed portions are finally disengaged. In contrast, when the first member and the second member are relatively moved in the direction in which the width gradually decreases, only a relatively small force is required to disengage the protruding portions and the depressed portions. In this way, a latching mechanism that has different latching forces depending on the relative movement direction can be easily configured.

In the above-described aspect, the depressed portions may extend in the relative movement direction of the first member and the second member, and the depths of the depressed portions may differ at both ends in the relative movement direction.

According to this structure, the direction in which the depth of the engagement of the protruding portions and the depressed portions changes differs when the first member and the second member are relatively moved in one direction and when the first member and the second member are relatively moved in another direction, from a state in which a plurality of protruding portions and a plurality of depressed portions are engaged with each other. Therefore, when the first member and the second member are relatively moved in the direction in which the engagement depth gradually increases, a relatively large force is required when the protruding portions and the depressed portions are finally disengaged. In contrast, when the first member and the second member are relatively moved in the direction in which the engagement depth gradually decreases, only a relatively small force is required to disengage the protruding portions and the depressed portions. In this way, a latching mechanism that has different latching forces depending on the relative movement direction can be easily configured.

In the above-described aspect, each of the protruding portions may include a spherical body having a spherical surface that engages with one of the depressed portions and a pushing member that pushes the spherical body toward the second member.

According to this structure, the spherical body is moved between a latched state in which the spherical surfaces of spherical body are engaged with the depressed portions and a state in which the engagement is disengaged so as to smoothly switch between the states.

The opening-and-closing mechanism according to the present invention affords an advantage in that it can be latched at a predetermined opening angle since the first supporting member and the second supporting member can be held at a plurality of predetermined relative alignments by providing a plurality of protruding portions and a plurality of depressed portion and by selecting the combinations of the protruding portions and depressed portions to be engaged.

There is a farther advantage in that, for example, in the opening direction of the first supporting member and the second supporting member, the latching is easily released and, in the closing direction, the latching is gradually released, since the force required for disengagement differs when the protruding portions and the depressed portions are disengaged in a first rotating direction and when the protruding portions and the depressed portions are disengaged in a second rotating direction.

The latching mechanism according to the present invention affords an advantage in that it has a simple structure and that the latching forces of two members can be set to be different depending on the relative movement direction of the two members which are relatively moved.

BEST MODE FOR CARRYING OUT THE INVENTION

An opening-and-closing mechanism of a container according to a first embodiment of the present invention will be described with reference to FIGS. 1 to 8.

Figure 1:
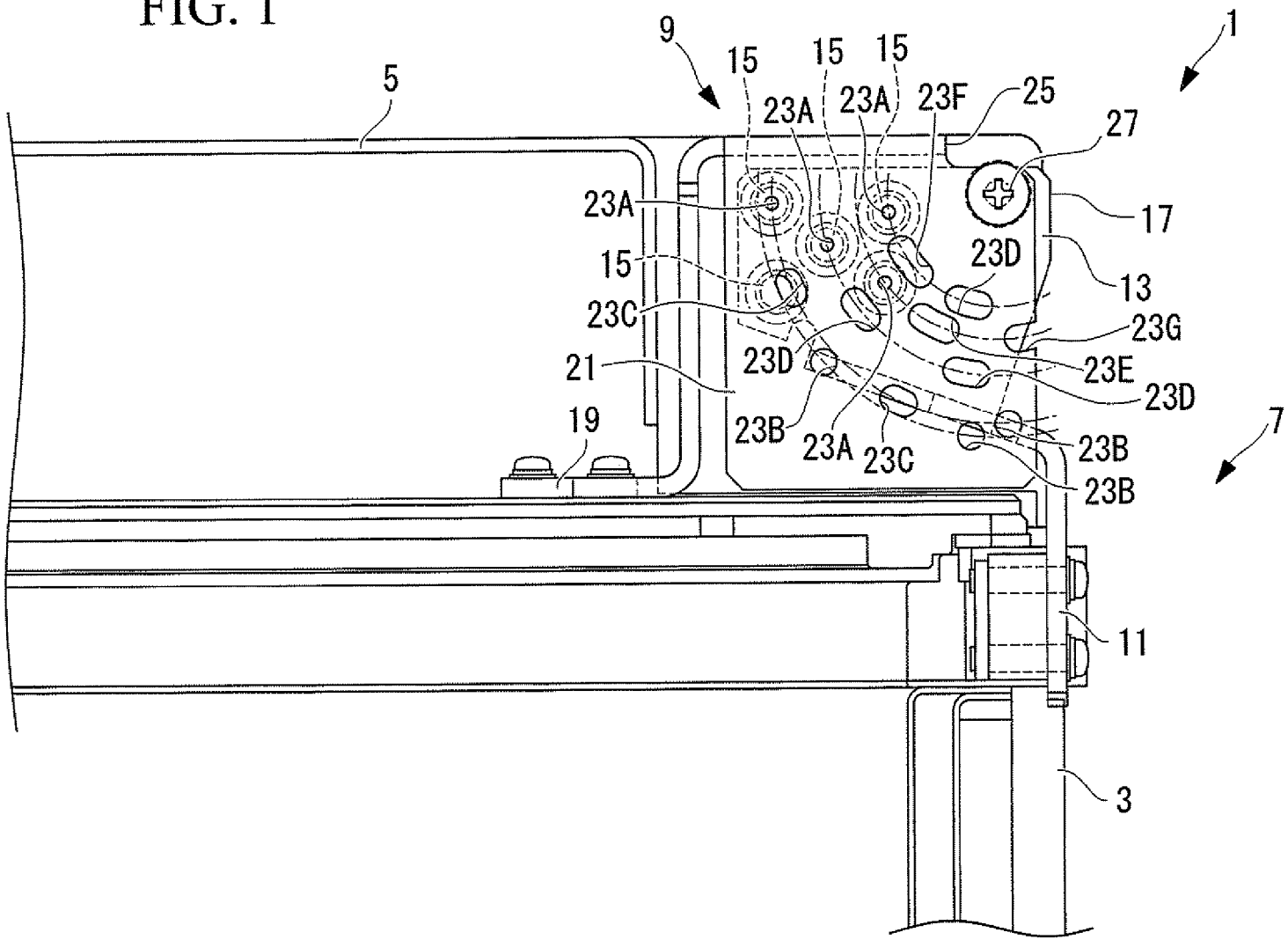
FIG. 1 is a schematic view of a container including an opening-and-closing mechanism according to a first embodiment of the present invention.

FIG. 1 is a schematic view of a container including the opening-and-closing mechanism according to the first embodiment of the present invention.

As shown in FIG. 1, an opening-and-closing mechanism 1 is interposed between a container 3 of a refrigerated compartment for storing reagents and a cover 5 covering an opening at the top of the container 3 and is positioned to support the cover 5 such that the cover 5 can be opened and closed.

As described above, the container 3 may be a container of a refrigerated compartment for storing reagents, but it is not limited thereto: it may be a container for an analyzer, such as a DNA analyzer or an antibody detector.

Figure 2:
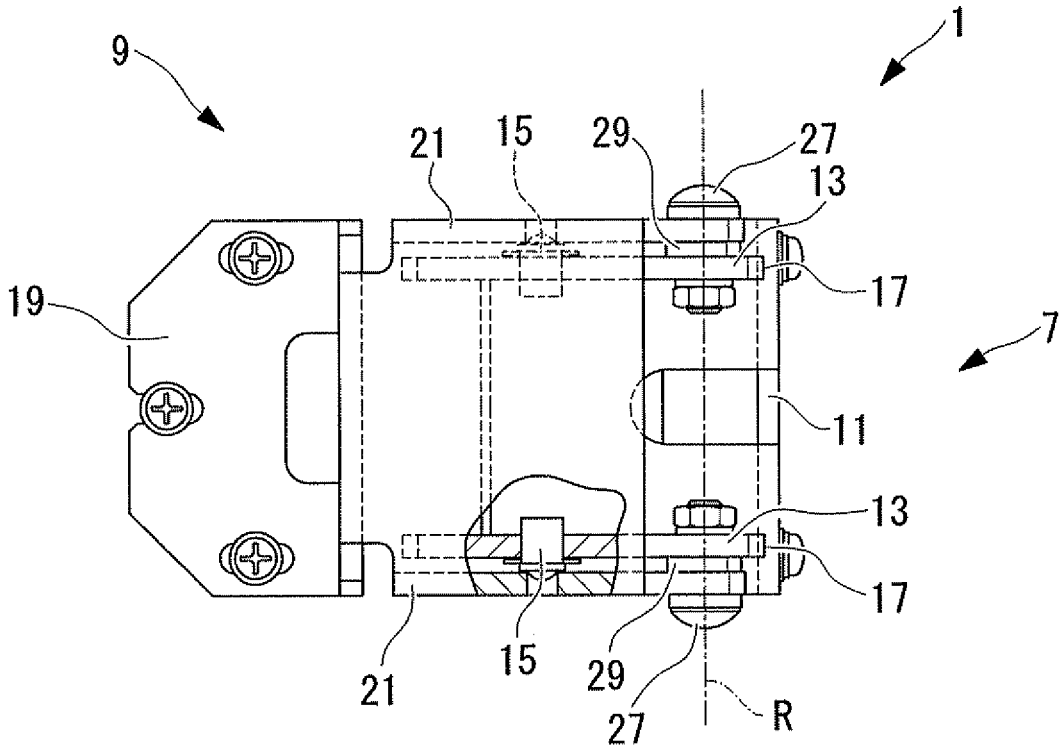
FIG. 2 illustrates, in outline, the overall structure of the opening-and-closing mechanism shown in FIG. 1.

FIG. 2 illustrates, in outline, the overall structure of the opening-and-closing mechanism shown in FIG. 1.

As shown in FIGS. 1 and 2, the opening-and-closing mechanism 1 is mainly formed of a container-side hinge (second supporting member) 7 that is fixed to the container 3 and a cover-side hinge (first supporting member) 9 that supports the cover 5 and is rotated around a rotary axis R with respect to the container-side hinge 7.

The container-side hinge 7 is mainly formed of a fixed portion 11 that is fixed to the container 3 by screws and a pair of container-side opposing surfaces 13 that oppose cover-side opposing surfaces of the cover-side hinge 9, described below.

Press-fit plungers (protruding portions) 15 that are engaged with depressed portions of the cover-side hinge 9, described below, and a container-side stopper surface (stopper portion) 17 that restricts the rotating range of the cover-side hinge 9, together with a cover-side stopper surface of the cover-side hinge 9, are disposed on the container-side opposing surfaces 13.

The press-fit plungers 15 are disposed at a total of five positions corresponding to each apex and the center of an imaginary rectangle formed on each of the container-side opposing surfaces 13. In other words, five press-fit plungers 15 are disposed on one of the container-side opposing surfaces 13; a total of ten press-fit plungers 15 are disposed on the pair of container-side opposing surfaces 13.

Figure 3:
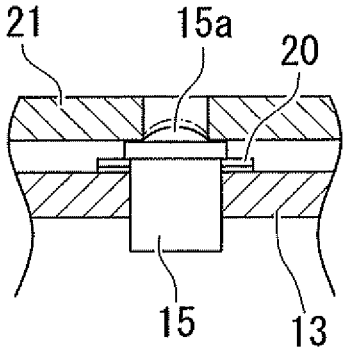
FIG. 3 is a partial cross-sectional view illustrating the position of a press-fit plunger shown in FIG. 2.

FIG. 3 is a partial cross-sectional view of the position of a press-fit plunger shown in FIG. 2.

As shown in FIG. 3, each of the press-fit plungers 15 is disposed such that a ball portion 15*a* faces outward. The heights of the press-fit plungers 15 protruding from the cover-side opposing surface 13 are adjusted by providing shims 20 between the press-fit plungers 15 and the cover-side opposing surface 13.

The ball portion 15*a* is structured such that it is urged in a direction protruding from the press-fit plunger 15 and is pushed toward the cover-side opposing surface 13 by an external force.

The cover-side hinge 9 is mainly formed of a fixed portion 19, fixed by the cover 5 and screws, and a pair of cover-side opposing surfaces 21 that opposes the above-described container-side opposing surfaces 13.

Depressed portions 23 that are engaged with the above-described press-fit plungers 15 and a cover-side stopper surface (stopper portion) 25 that restricts the rotating range of the cover-side hinge 9, together with the above-described container-side stopper surface 17, are provided on the cover-side opposing surfaces 21.

The depressed portions 23 are formed as through-holes in the cover-side opposing surfaces 21 and are categorized into depressed portions 23A, 23B, 23C, 23D, 23E, 23F, and 23G, depending on their shape.

The depressed portions 23A and 23B have substantially circular shapes. The depressed portions 23A have a smaller diameter than that of the depressed portions 23B.

The depressed portions 23C, 23D, 23E, and 23F are formed as elongated holes extending around a circle centered at a rotary axis C. The length of the elongated holes in the direction of the longitudinal axis becomes gradually greater from the depressed portions 23C to the portions 23F.

The depressed portions 23G are elongated holes extending around a circle centered at a rotary axis C and are shaped as cutouts having ends that open toward the outside.

The depressed portions 23A, 23B, 23C, 23D, 23E, 23F, and 23G, are aligned on the circumferences of circles concentric with the rotary axis C.

More specifically, the depressed portions 23F, 23D, and 23A are on the circumference of a first circle closest to the rotary axis C and are aligned in the opening direction of the cover-side hinge 9. Similarly, the depressed portions 23G, 23E, and 23A are aligned on the circumference of a second circle closer to the rotary axis C than the first circle. Similarly, the depressed portions 23D, 23D, and 23A are aligned on the circumference of a third circle closer to the rotary axis C than the second circle. Similarly, the depressed portions 23B, 23C, 23C, and 23A are aligned on the circumference of a fourth circle closer to the rotary axis C than the third circle. Similarly, the depressed portions 23B and 23B are aligned on the circumference of fifth circle farthest from the rotary axis C.

The diameters of the above-mentioned first, second, third, fourth, and fifth circles are equal to the distances from the press-fit plungers 15 to the rotary axis C.

The cover-side opposing surface 13 and the cover-side opposing surface 21 are connected by a screw (connecting member) 27 in such a manner as to allow rotation around the rotary axis C. A washer (sliding member) 29 formed of resin is disposed in the area around the screw 27, between the cover-side opposing surface 13 and the cover-side opposing surface 21.

Next, the operation of the opening-and-closing mechanism 1 having the above-described structure will be described with reference to FIGS. 4 to 8. First, the operation of the press-fit plungers and the depressed portions when the cover 5 is opened will be described.

Figure 4:
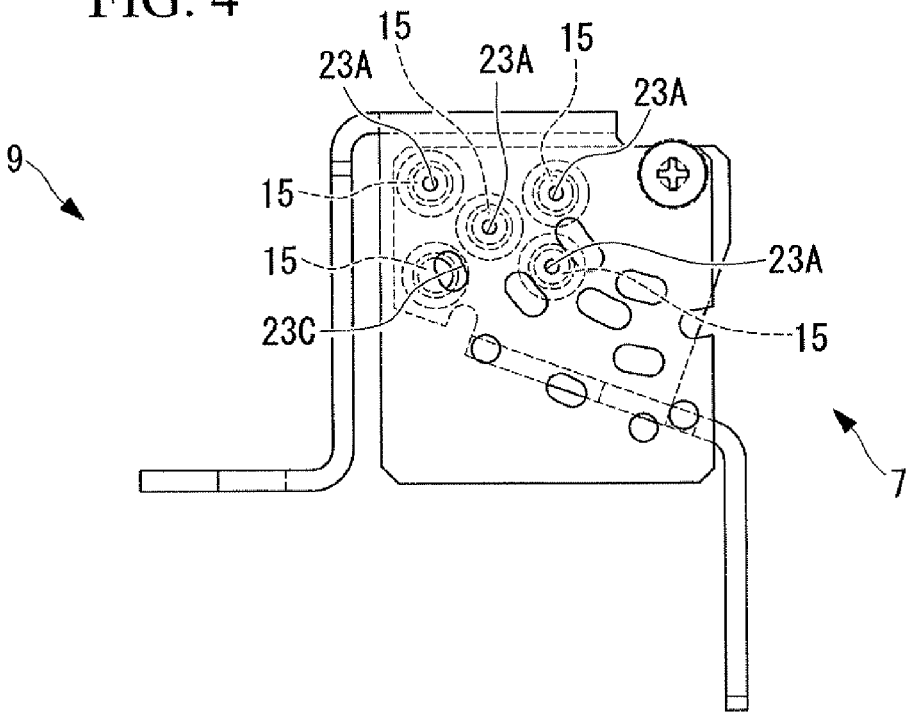
FIG. 4 illustrates the engagement of press-fit plungers and depressed portions when a cover shown in FIG. 1 is closed.

FIG. 4 illustrates the engagement of the press-fit plungers and depressed portions when the cover shown in FIG. 1 is closed.

As shown in FIG. 4, when the cover 5 covers the opening of the container 3 (when the opening angle (relative alignment) is 0°), and eight press-fit plungers 15 engage with the depressed portions 23A, two press-fit plungers 15 engage with parts of the depressed portions 23C. In this way, the engagement of the press-fit plungers 15 and the depressed portions 23A and 23C generates a holding force for holding the cover 5 in a closed state.

Figure 5:
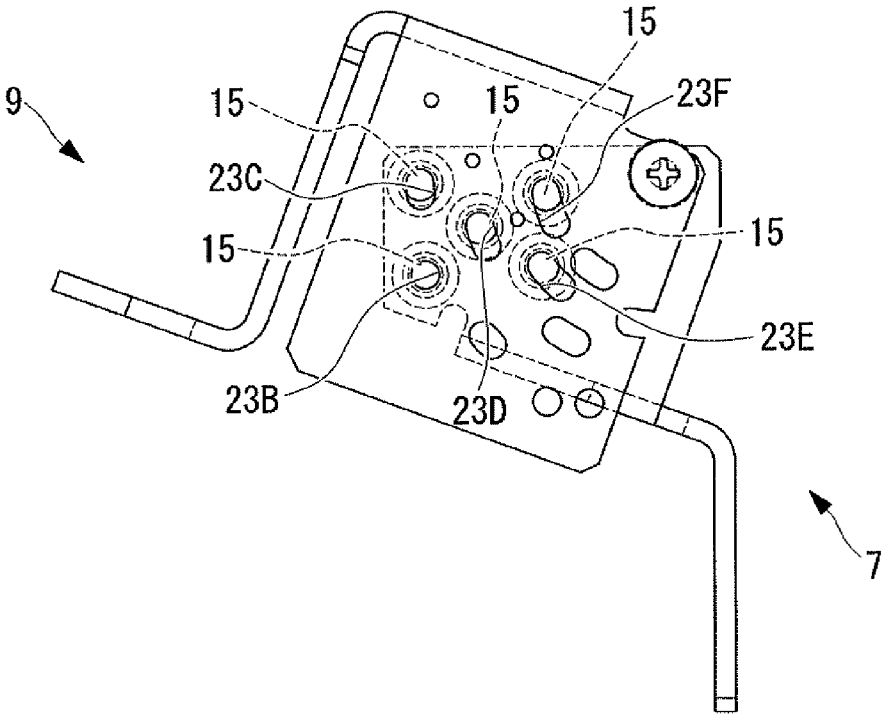
FIG. 5 illustrates the engagement of the press-fit plungers and the depressed portions when the opening angle of the cover shown in FIG. 1 is 20°.

FIG. 5 illustrates the engagement of the press-fit plungers and the depressed portions when the opening angle of the cover shown in FIG. 1 is 20°.

When the cover 5 is opened from a closed state, the press-fit plungers 15 and the depressed portions 23A and 23C are disengaged. Then, when the opening angle of the cover 5 reaches 20°, as shown in FIG. 5, two of the press-fit plungers 15 and the depressed portions 23B, two of the press-fit plungers 15 and the depressed portions 23C, two of the press-fit plungers 15 and the depressed portions 23D, two of the press-fit plungers 15 and the depressed portions 23E, and two of the press-fit plungers 15 and the depressed portions 23F are engaged.

In this way, the engagement of the press-fit plungers 15 and the depressed portions 23B, 23C, 23D, 23E, and 23F generates a holding force for holding the cover 5 at an opening angle of 20°.

Then, as the cover 5 is opened further from the opening angle of 20°, first, two of the press-fit plungers 15 and the depressed portions 23B are disengaged. By disengaging two of the engagements, the holding force holding the cover 5 at the opening angle is reduced, causing a decrease in the force required to open the cover 5.

As the cover 5 is opened further, next, two other press-fit plungers 15 and the depressed portions 23C are disengaged. By disengaging a total of four engagements, the holding force holding the cover 5 at the opening angle is reduced, causing a further decrease in the force required to open the cover 5.

Subsequently, as the cover 5 is opened, the press-fit plungers 15 and the depressed portions 23D, the press-fit plungers 15 and the depressed portions 23E, and the press-fit plungers 15 and the depressed portions 23F are disengaged in sequence. As the engagements are disengaged, the holding force holding the cover 5 at the opening angle is reduced, causing a decrease in the force required to open the cover 5.

Figure 6:
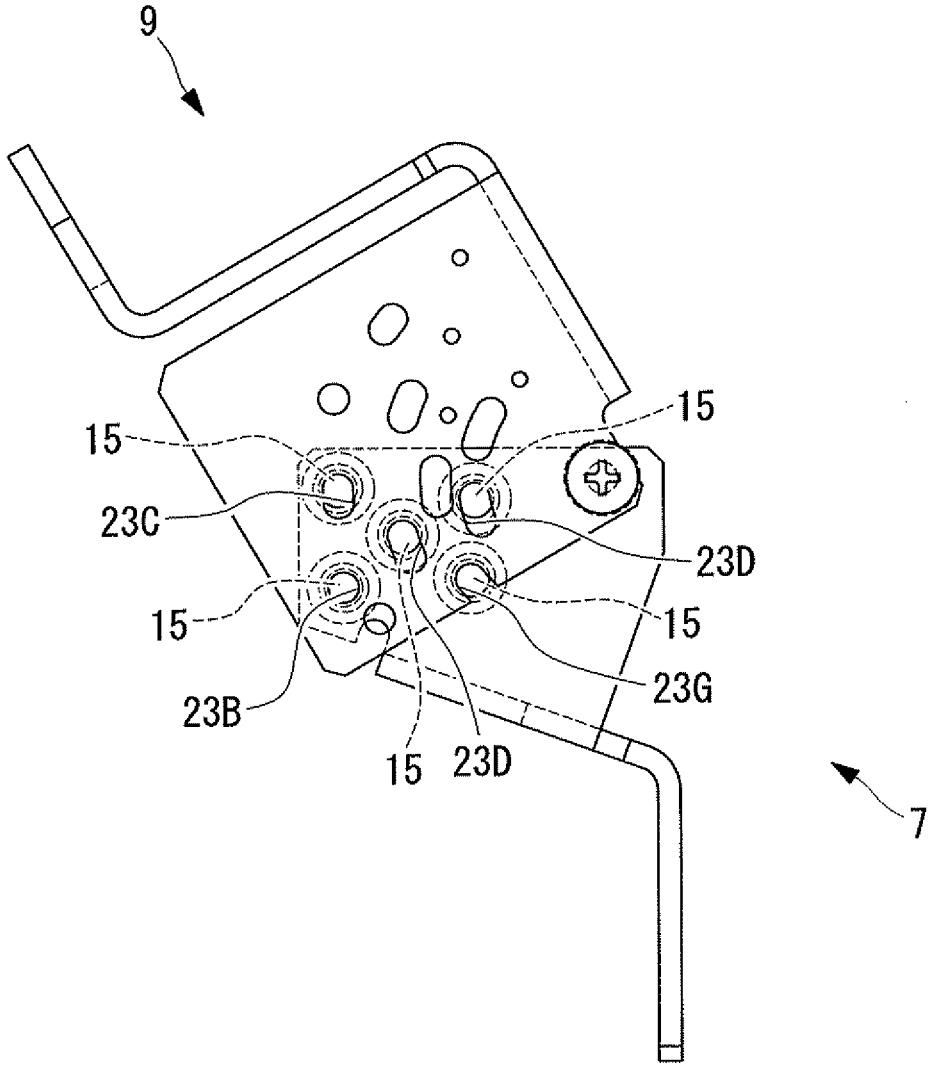
FIG. 6 illustrates the engagement of the press-fit plungers and the depressed portions when the opening angle of the cover shown in FIG. 1 is 60°.

FIG. 6 illustrates the engagement of the press-fit plungers and the depressed portions when the opening angle of the cover shown in FIG. 1 is 60°.

As shown in FIG. 6, when the cover 5 reaches an opening angle of 60°, two of the press-fit plungers 15 and the depressed portions 23B, two of the press-fit plungers 15 and the depressed portions 23C, four of the press-fit plungers 15 and the depressed portions 23D, and two of the press-fit plungers 15 and the depressed portions 23G are engaged.

In this way, the engagement of the press-fit plunger 15 and the depressed portions 23B, 23C, 23D, and 23G generates a holding force for holding the cover 5 at an opening angle of 60°.

As the cover 5 is further opened from the opening angle of 60°, first, two of the press-fit plungers 15 and the depressed portions 23B are disengaged. By disengaging two engagements, the holding force holding the cover 5 at the opening angle is reduced, causing a decrease in the force required to open the cover 5.

Subsequently, as the cover 5 is opened, the press-fit plungers 15 and the depressed portions 23C, the press-fit plungers 15 and the depressed portions 23G, and the press-fit plungers 15 and the depressed portions 23D are disengaged in sequence. As the engagements are disengaged, the holding force holding the cover 5 at the opening angle is reduced, causing a decrease in the force required to open the cover 5.

Figure 7:
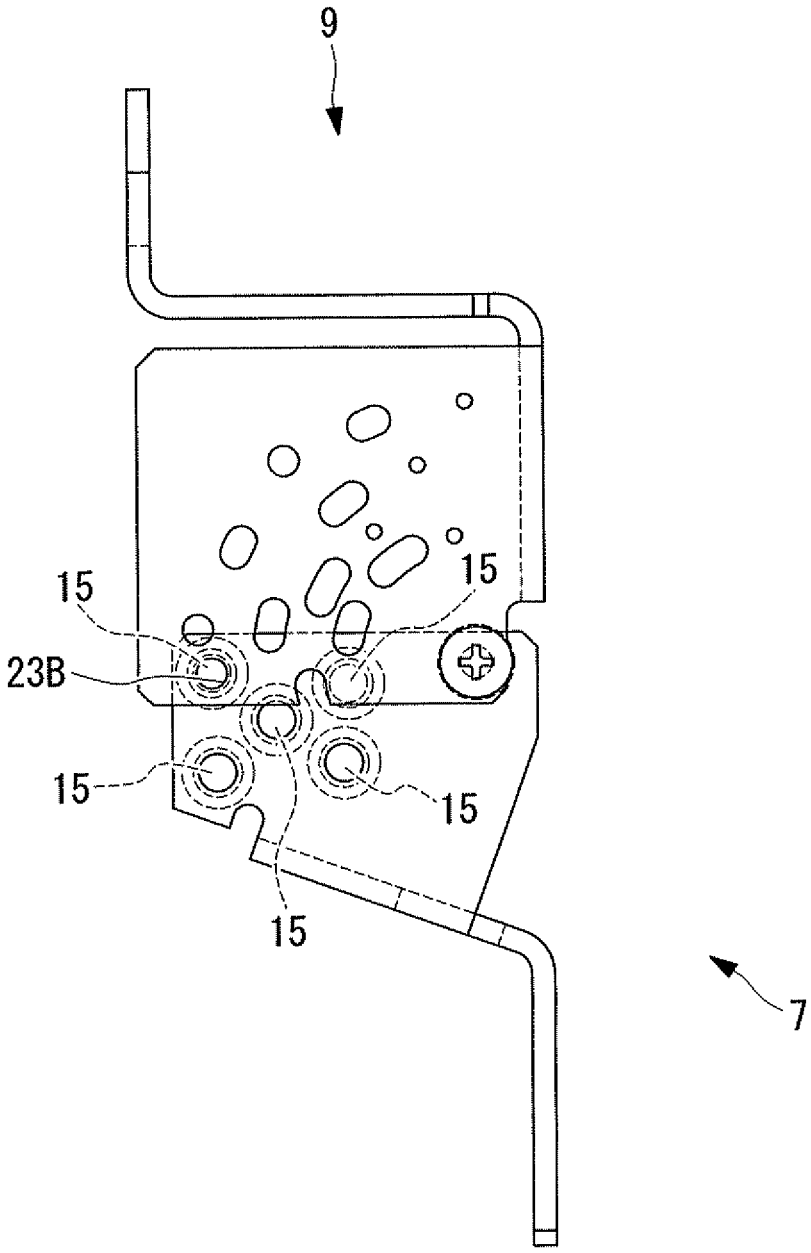
FIG. 7 illustrates the engagement of the press-fit plungers and the depressed portions when the opening angle of the cover shown in FIG. 1 is 90°.

FIG. 7 illustrates the engagement of the press-fit plungers and the depressed portions when the opening angle of the cover shown in FIG. 1 is 90°.

As shown in FIG. 7, when the cover 5 reaches an opening angle of 90°, two of the press-fit plungers 15 and the depressed portions 23B are engaged. The engagement of the press-fit plunger 15 and the depressed portions 23B generates a holding force for holding the cover 5 at an opening angle of 90°.

Then, as the cover 5 is opened further from the opening angle of 90°, two of the press-fit plungers 15 and the depressed portions 23B are disengaged. By disengaging the engagements, the holding force holding the cover 5 at the opening angle is reduced, causing a decrease in the force required to open the cover 5.

Figure 8:
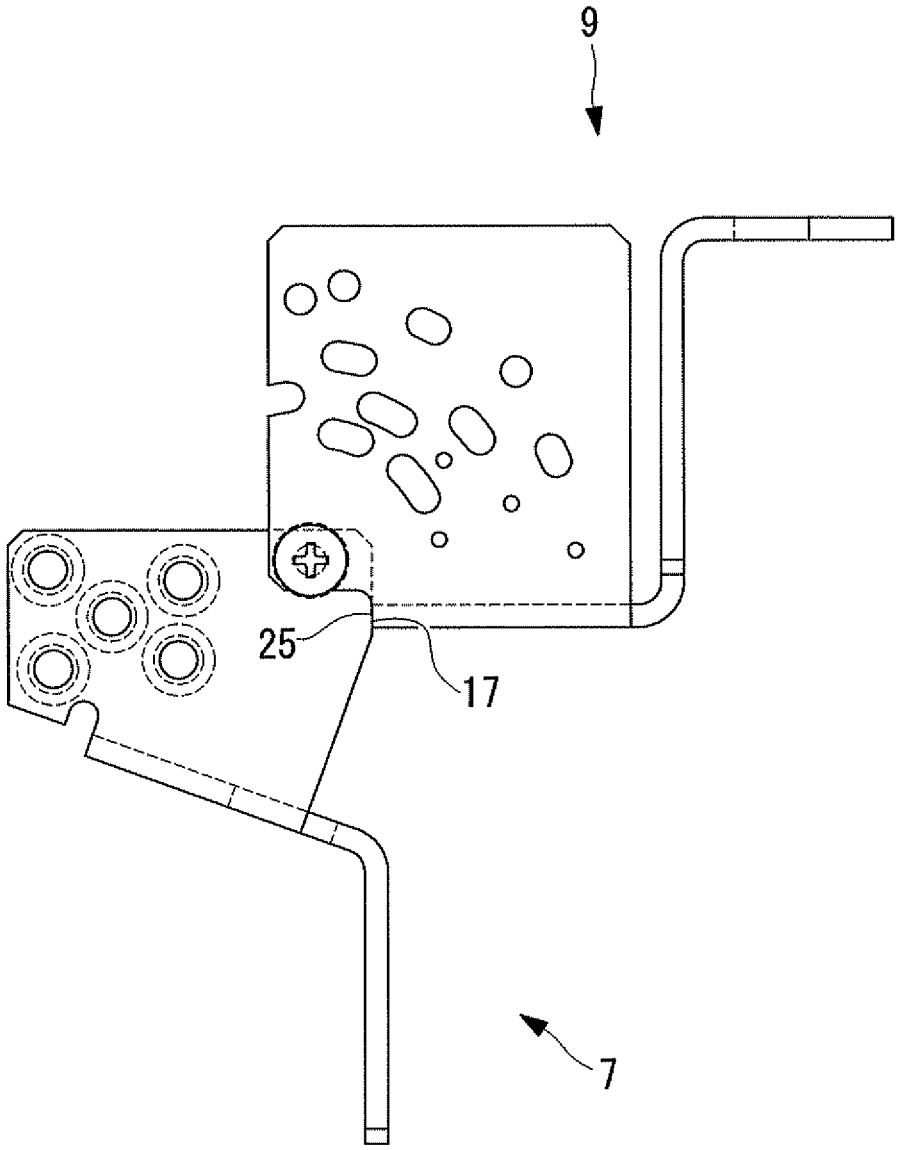
FIG. 8 illustrates the engagement of the press-fit plungers and the depressed portions when the opening angle of the cover shown in FIG. 1 is 180°.

FIG. 8 illustrates the engagement of the press-fit plungers and the depressed portions when the opening angle of the cover shown in FIG. 1 is 180°.

As shown in FIG. 8, when the cover 5 reaches an opening angle of 180°, the container-side stopper surface 17 and the cover-side stopper surface 25 contact each other. The opening angle of the cover 5 is prevented from exceeding 180° by the stopper surfaces 17 and 25 coming into contact.

The operation of the press-fit plungers 15 and the depressed portions 23A, 23B, 23C, 23D, 23E, and 23F when the cover 5 is closed is substantially the same as the operation when the cover 5 is opened, and thus, description thereof is omitted.

According to the above-described structure, by providing a plurality of press-fit plungers 15 and a plurality of depressed portions 23A, 23B, 23C, 23D, 23E, and 23F and selecting combinations of the press-fit plungers 15 and the depressed portions 23A, 23B, 23C, 23D, 23E, and 23F, the cover-side hinge 9 and the container-side hinge 7 can be held at a plurality of predetermined opening angles (0°, 20°, 60°, and 90°). Since the cover-side hinge 9 and the container-side hinge 7 can be held at a plurality of predetermined opening angles, even when the press-fit plungers 15 and the depressed portions 23A, 23B, 23C, 23D, 23E, and 23F are disengaged, the cover-side hinge 9 and the container-side hinge 7 are held at another adjacent predetermined opening angle. Therefore, slamming of the cover-side hinge 9 and the cover 5 can be prevented.

The depressed portions 23C, 23D, 23E, and 23F are arc-shaped, extending in the circumferential direction, and the positions and lengths around the circumference of the depressed portions 23A, 23B, 23C, 23D, 23E, and 23F are set such that the number of press-fit plungers 15 and the depressed portions 23A, 23B, 23C, 23D, 23E, and 23F to be simultaneously disengaged are different depending on the rotating directions of the cover-side hinge 9.

Therefore, the force required for disengaging the cover-side hinge 9 at a predetermined opening angle in the direction of opening the cover 5 and the force required for disengaging the cover-side hinge 9 in the direction of closing the cover 5 can be set to be different.

Since the number of press-fit plungers 15 and the depressed portions 23A, 23B, 23C, 23D, 23E, and 23F to be simultaneously disengaged is set to a predetermined number, all of the engaged press-fit plungers 15 and depressed portions 23 that hold the cover-side hinge 9 at a predetermined opening angle are not disengaged simultaneously.

In other words, as the opening angle of the cover-side hinge 9 deviates from any of the predetermined opening angles mentioned above, the number of engaged press-fit plungers 15 and depressed portions 23 decreases. Therefore, the force holding the cover-side hinge 9 at any of the predetermined opening angles mentioned above decreases as the opening angle deviates from that predetermined opening angle.

Since the screw 27 controls the pushing force acting upon the contact surface of the cover-side hinge 9 and the container-side hinge 7, the friction force between the cover-side hinge 9 and the container-side hinge 7 can be controlled. Therefore, the force required to relatively rotate the cover-side hinge 9 and the container-side hinge 7 can be controlled.

By providing the washer 29 between the cover-side hinge 9 and the container-side hinge 7, the coefficient of friction between the cover-side hinge 9 and the container-side hinge 7 can be controlled. Therefore, the force required to relatively rotate the cover-side hinge 9 and the container-side hinge 7 can be controlled.

By providing the cover-side stopper surface 25 and the container-side stopper surface 17 on the cover-side hinge 9 and the container-side hinge 7, respectively, the maximum opening angle of the cover-side hinge 9 and the container-side hinge 7 can be limited to 180°. Since the cover 5 opens to a maximum angle of 180°, the operator can access the inside of the container 3 from the back side (right side in FIG. 1) of the container 3.

Furthermore, damage caused by the cover 5 opening too far can be prevented by the container-side stopper surface 17 and the cover-side stopper surface 25.

As described above, the diameters of the depressed portions 23A and 23B can be changed; the lengths in the longitudinal-axis direction of the depressed portions 23C, 23D, 23E, and 23F can be set to be different; and the widths in the radial direction from the rotary axis C of the depressed portions 23 can be set to be different from one end to another end.

By forming the depressed portions 23 in this way, the force required for disengaging the press-fit plungers 15 and the depressed portions 23 in the opening direction of the cover 5 can be set to be different from the force required for disengaging the press-fit plungers 15 and the depressed portions 23 in the closing direction of the cover 5. More specifically, the force required for disengaging the press-fit plungers 15 and the depressed portions at the end having a greater width in the radial direction can be set greater than the force required for disengaging the press-fit plungers 15 and the depressed portions at the end having a smaller width.

The depths of the depressed portions 23 may be set to be different at the circumferential edge around the rotary axis C.

By forming the depressed portions 23 in this way, the force required for disengaging the press-fit plungers 15 and the depressed portions 23 in the opening direction of the cover 5 can be set to be different from the force required for disengaging the press-fit plungers 15 and the depressed portions 23 in the closing direction of the cover 5. More specifically, the force required for disengaging the press-fit plungers 15 and the depressed portions 23 at the end with the greater depth can be set to be greater than the force required for disengaging the press-fit plungers 15 and the depressed portions 23 at the end with the smaller depth.

At the end with the smaller depth, the front surface and the bottom surface of the cover-side opposing surfaces 21 having the depressed portions 23 may be formed such that they are smoothly connected. In this way, the press-fit plungers 15 and the depressed portions 23 can be smoothly disengaged, thus reducing the force required for disengagement.

The technical scope of the present invention is not limited to the first embodiment: various modifications may be made within the scope of the present invention.

For example, according to the first embodiment, the cover 5 is configured such that it is held at opening angles of 0°, 20°, 60°, and 90°. However, the opening angles are not limited thereto, and the cover 5 may be held at other predetermined opening angles.

According to the first embodiment, the opening-and-closing mechanism 1 includes the container 3 that has a substantially horizontal opening. However, the present invention may be employed in an opening-and-closing mechanism including a container 3 having an inclined opening or opening-and-closing mechanisms having various other types of container.

According to the above-described first embodiment, the present invention is employed in an opening-and-closing mechanism for a cover of a container in a refrigerated compartment or a container in an analyzer, such as a DNA analyzer or an antibody detector. However, the present invention is not limited to the above-described embodiment and may be employed in an opening-and-closing mechanism for a rotary cover used for opening and closing a piano, a notebook computer, or office equipment, such as a copy machine.

A latching mechanism according to a second embodiment of the present invention will be described below with reference to FIGS. 9 to 11.

A latching mechanism 31 according to this embodiment is interposed between an outer member (first member) 32 and an inner member (second member) 33 disposed so as to be capable of relative rotation around a rotary axis and includes a plurality of protruding portions 34 provided on the outer member 32 and a plurality of depressed portions 35 provided on the inner member 33.

Each of the depressed portions 35 is formed as a groove extending around the circumference of the outer circumferential surface of the cylindrical inner member 33. According to this embodiment, the depressed portions 35 are provided in parallel at three positions separated in the axial direction of the inner member 33.

Figure 9:
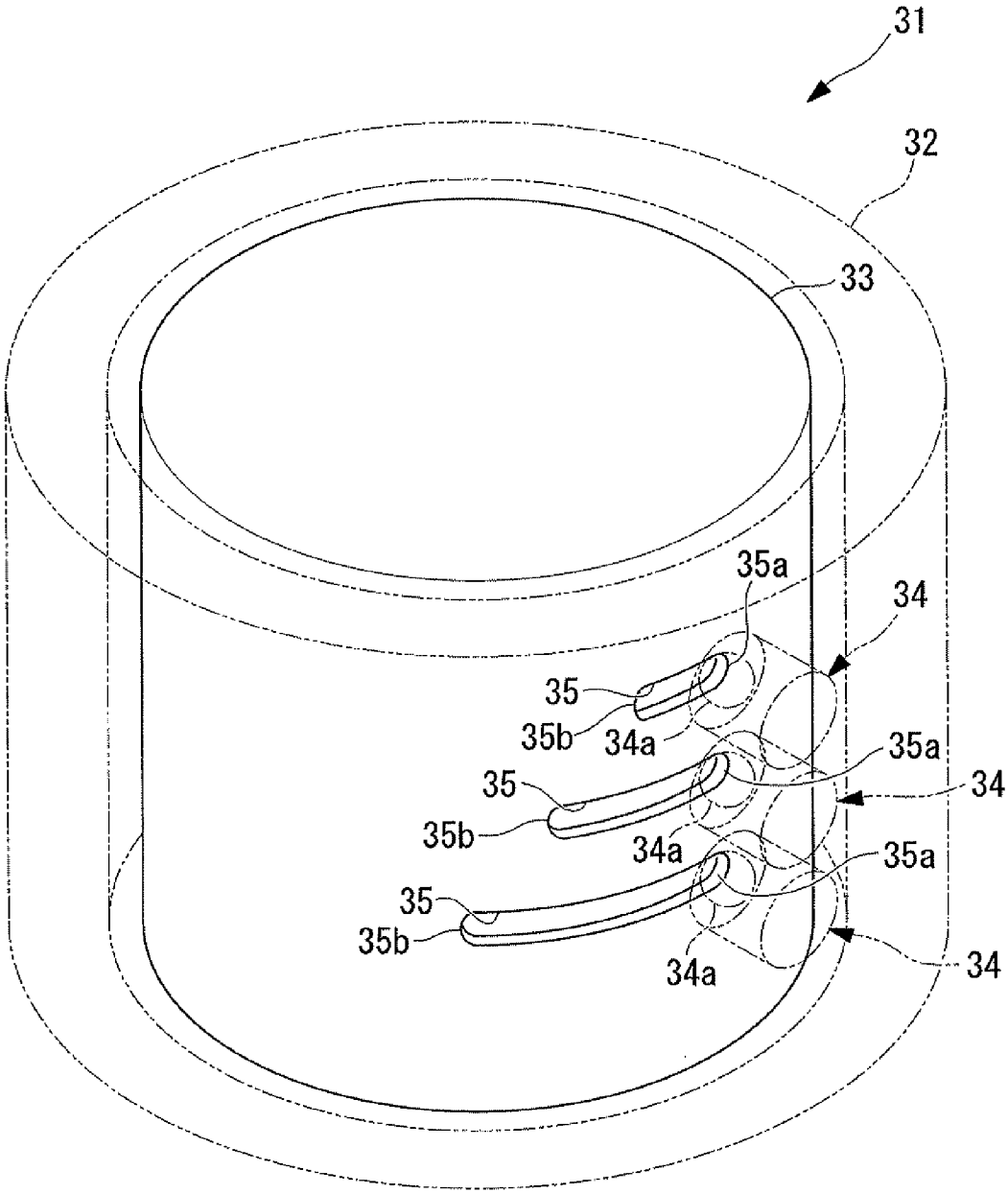
FIG. 9 is a perspective view of a latching mechanism according to a second embodiment of the present invention.

In the example shown in FIG. 9, the lengths of all three depressed portions 35 differ and increase from top to bottom. End sections 35*a* of the depressed portions 35 are aligned in the axial direction, and the other end sections 35*b* are disposed at different positions along the circumference.

Figure 10A:
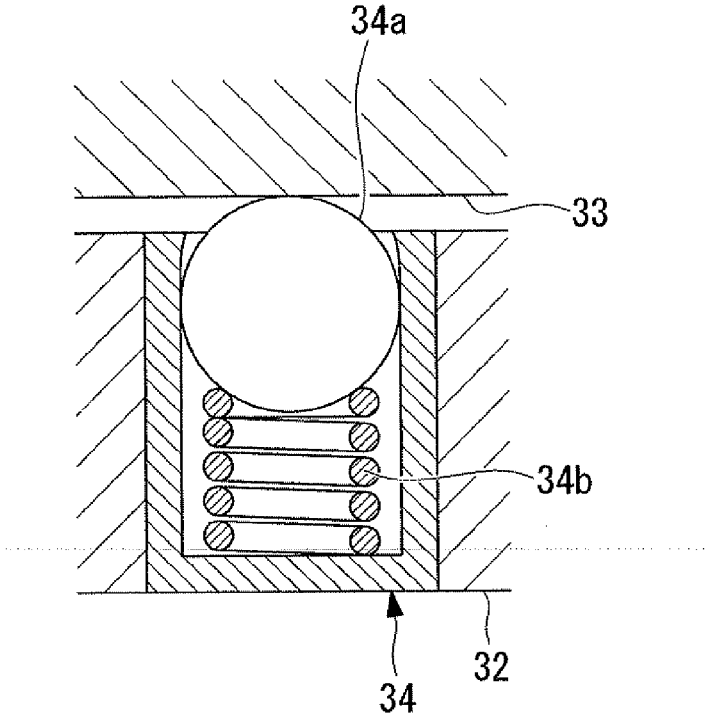
FIG. 10A is a longitudinal cross-sectional view of a press-fit plunger constituting a protruding portion of the latching mechanism shown in FIG. 9, when the protruding portion and a depressed portion are disengaged.

The protruding portions 34 provided on the outer member 32 are provided at three positions in parallel in the axial direction, such that they oppose the three depressed portions 35. As shown in FIG. 10A, each of the protruding portions 34 is formed of a press-fit plunger (hereinafter, may also be referred to as press-fit plunger 34) including, at the tip, a ball portion (spherical body) 34*a* that is capable of moving forward and backward. For example, a coil spring (pushing member) 34*b* is disposed inside the press-fit plunger 34 and constantly urges the ball portion 34*a* in a direction that causes the ball portion 34*a* to protrude. The protruding portions 34 are disposed such that the ball portions 34*a* face inward in the radial direction, and all of the protruding portions 34 are aligned along the axial direction.

The operation of the latching mechanism 31 according to the second embodiment, having the above-described structure, will be described below.

Figure 11A:
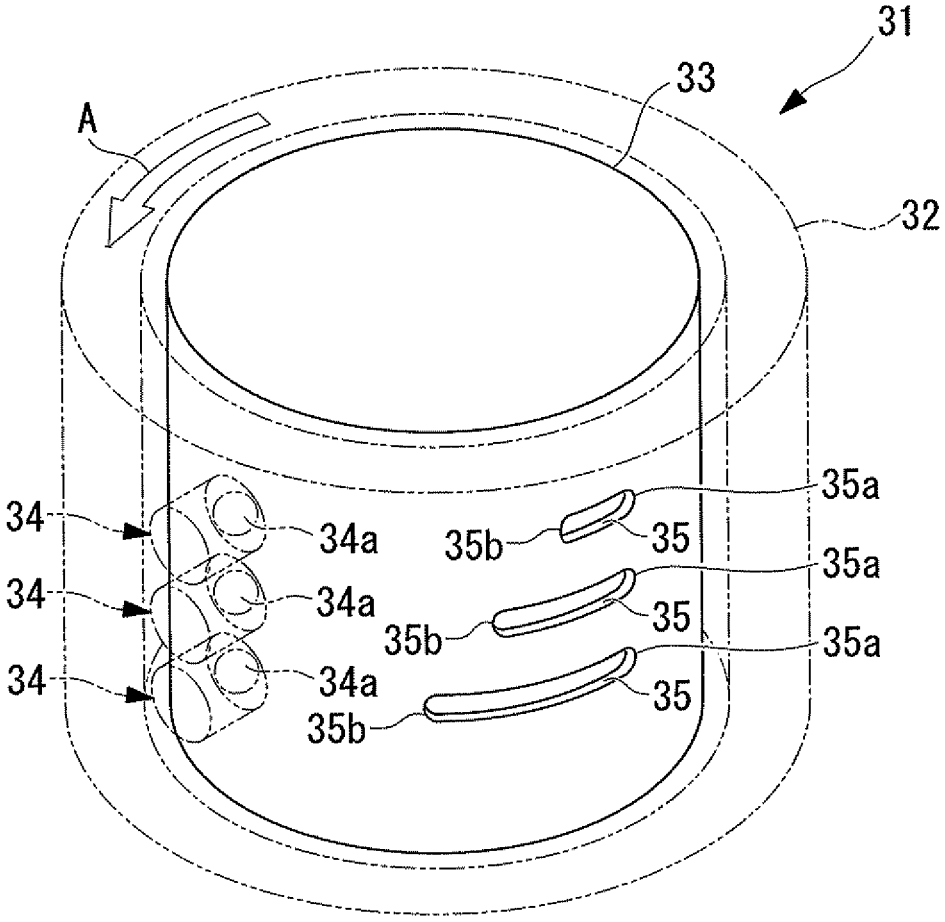
FIG. 11A is a perspective view of the latching mechanism shown in FIG. 9, when the protruding portion and the depressed portion are disengaged.

With the latching mechanism 31, in a first state, as shown in FIG. 11A, in which the protruding portions 34 of the outer member 32 are not engaged with the depressed portions 35 of the inner member 33, the ball portions 34*a* of the press-fit plungers 34 are pushed outward in the radial direction of the outer circumferential surface of the inner member 33, causing the coil springs 34*b* inside to be compressed and retracted, as shown in FIG. 10A. In this state, since the ball portions 34*a* roll while being in point-contact with the outer circumferential surface of the inner member 33, the inner member 33 and the outer member 32 freely rotate relative to each other.

Figure 10B:
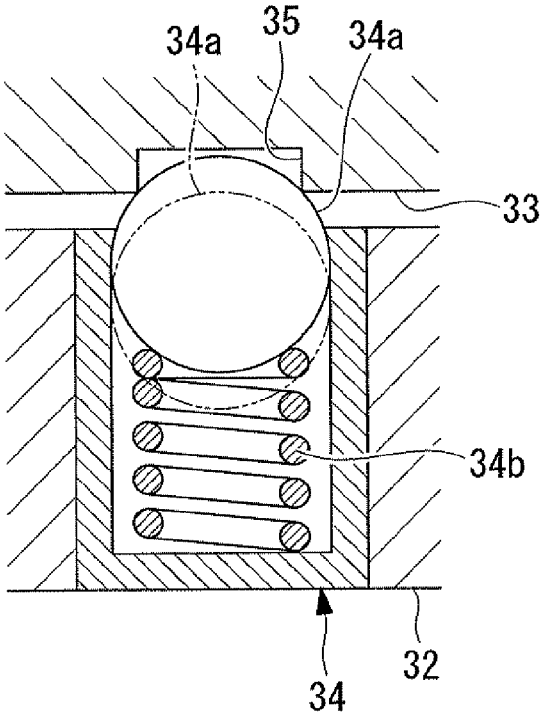
FIG. 10B is a longitudinal cross-sectional view of a press-fit plunger constituting a protruding portion of the latching mechanism shown in FIG. 9, when the paired protruding portion and the depressed portion is engaged.
Figure 11B:
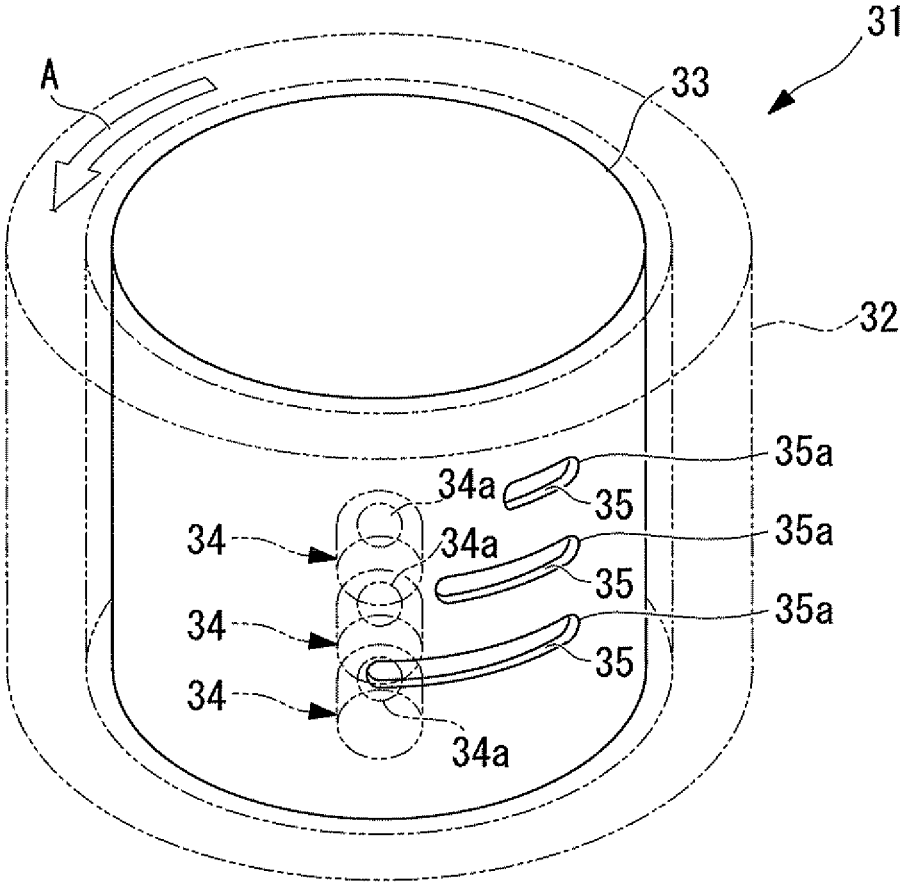
FIG. 11B is a perspective view of the latching mechanism shown in FIG. 9, when the paired protruding portion and the depressed portion is engaged.

Next, as shown in FIG. 11B, by rotating the outer member 32 in the direction indicated by an arrow A in FIG. 11A, the ball portion 34*a* of the press-fit plunger 34 constituting the protruding portion 34 falls into the depressed portion 35 at a position where the protruding portion 34 corresponding to the end section 35*b* of the longest depressed portion 35 is aligned with the end section 35*b* and enters a state illustrated in FIG. 10B. Since the depressed portions 35 are formed as grooves extending around the circumference, the depressed portions 35 and the press-fit plunger 34 are not latched, and the outer member 32 can further rotate. Subsequently, by continuing to rotate the outer member 32 in the direction of the arrow A, the ball portions 34*a* of the press-fit plungers 34 constituting the protruding portions 34 fall into the depressed portions 35 at positions where the protruding portions 34 corresponding to the end sections 35*b* are aligned with the end sections 35*b*, and all of the depressed portions 35 and the protruding portions 34 are engaged.

From this state, as the outer member 32 is further rotated in the same direction, all of the protruding portions 34 are positioned to coincide with the positions of the end sections 35*a* of the depressed portions 35, as shown in FIG. 9. In other words, in this state, since the end sections 35*a* of the depressed portions 35 are aligned in the axial direction at these positions, the engagement of all of the ball portions 34*a* of the press-fit plungers 34 constituting the protruding portions 34 and the depressed portions 35 must be simultaneously disengaged to rotate the outer member 32 further in the direction indicated by the arrow A.

To disengage the ball portions 34*a* and the depressed portions 35, the ball portions 34*a* of the press-fit plungers 34 must be pushed back against the pushing force of the coil springs 34*b*, which requires a predetermined amount of force. In the example shown in the drawing, the predetermined amount of force required is equal to three times the force that moves one ball portion 34*a* of the press-fit plunger 34.

As shown in FIG. 9, when the outer member 32 is rotated in the direction opposite to the direction indicated by the arrow A from a state in which all of the protruding portions 34 and the depressed portions 35 are engaged, since the end sections 35*b* of the depressed portions 35 are not aligned in the axial direction, the engaged depressed portions 35 and the protruding portions 34 are disengaged one by one when each of the ball portions 34*a* of the press-fit plungers 34 constituting the protruding portions 34 passes by the position where the ball portion 34*a* coincide with the corresponding end section of the depressed portion 35. In other words, the force required for disengaging the depressed portions 35 and the protruding portions 34 when the outer member 32 is rotated in this direction is merely the force for moving back the ball portion 34*a* of one of the press-fit plungers 34.

In this way, with the latching mechanism 31 according to the second embodiment, regardless of the rotating direction of the outer member 32 with respect to the inner member 33, all of the protruding portions 34 and the depressed portions 35 can be engaged. The force required for disengaging the engagement can set so as to differ by a factor of three for the case in which the outer member 32 is rotated in the direction of the arrow A and for the case in which the outer member 32 is rotated in the opposite direction.

Therefore, for example, by horizontally disposing the latching mechanism 31 according to this embodiment, fixing the inner member 33 to a base (not shown), fixing the outer member 32 to a cover (not shown) that is opened and closed vertically, and setting the direction of the arrow A in a direction for closing the cover downward, the cover can be opened upward with a small force, but when closing the cover, the cover can be latched by a relatively large latching force at an intermediate position. As a result, with the latching mechanism 31 according to this embodiment, a heavy, large cover can be prevented from slamming closed.

Moreover, by disposing the latching mechanism 31 according to the second embodiment in a direction shown in FIG. 9, fixing the inner member 33 to a sidewall (not shown), fixing the outer member 32 to a door (not shown), and setting the direction of the arrow A in a direction for closing the door, a large force is not required for opening the door, but when closing the door, the door can be latched by a relatively large latching force, preventing a heavy, large door from slamming closed.

With the latching mechanism 31 according to the second embodiment, the inner member 33 is fixed and the outer member 32 is rotated. However, it is not limited thereto, and, instead, the latching mechanism 31 may be employed by fixing the outer member 32 and rotating the inner member 33 or by relatively rotating both the outer member 32 and the inner member 33.

With the latching mechanism 31 according to the second embodiment, the depressed portions 35 are provided on the outer surface of the inner member 33, and the protruding portions 34 protruding inward in the radial direction are provided on the inside of the outer member 32. Instead, however, protruding portions 34 protruding outward in the radial direction may be provided on the outer surface of the inner member 33, and the depressed portions 35 may be provided on the inner surface of the outer member 32.

With the latching mechanism 31 according to the second embodiment, the group of depressed portions 35 corresponding to the protruding portions 34 provided on the outer member 32 is provided on the outer surface of the inner member 33. Instead, however, a plurality of pairs of depressed portions 35 may be disposed on the circumference of a circle at predetermined intervals. In such a case, the magnitudes of the latching forces of the pairs of depressed portions 35 may be equal or different. In contrast, a plurality of pairs of protruding portions 34 may be provided for each pair of depressed portions 35 in on the circumference of a circle at predetermined intervals.

Figure 12:
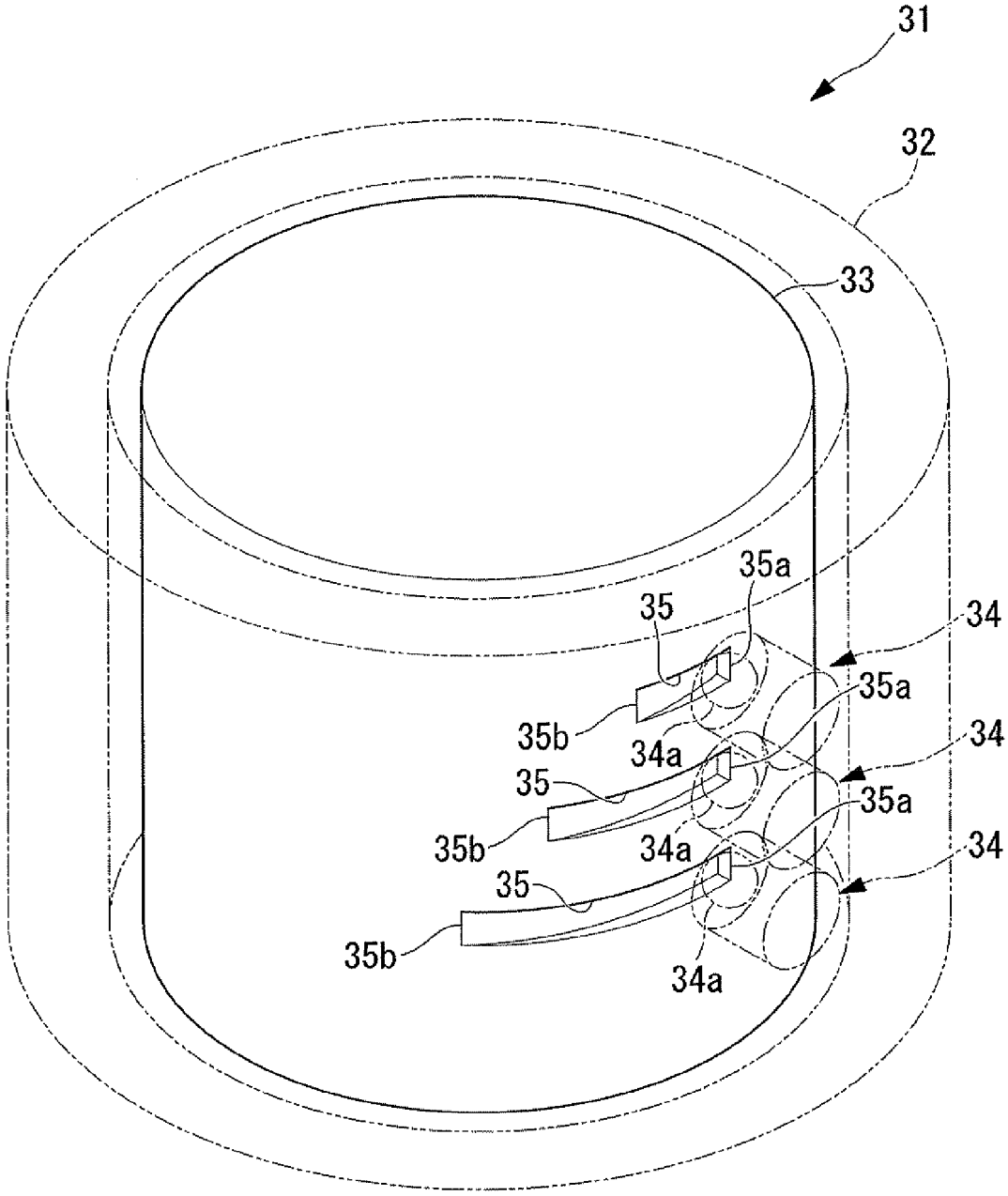
FIG. 12 is a perspective view of a first modification of the latching mechanism shown in FIG. 9.

With the latching mechanism 31 according to the second embodiment, by changing the lengths of the plurality of groove-shaped depressed portions 35 extending along the circumferential direction, the number of protruding portions 34 and depressed portions 35 to be simultaneously disengaged is set to be different according to the relative rotation direction. Instead or in addition to this, as shown in the Modified Example in FIG. 12, the depths of the depressed portions 35 may be set to be different depending on the relative rotation direction. In this way, the force required for disengaging the ball portion 34*a* from the end section 35*b* on the side with a small depth is smaller than the force required for disengaging the ball portion 34*a* of the press-fit plungers 34 constituting the protruding portion 34 from the end section 35*a* of the depressed portion 35 on the side with a large depth, and thus the latching forces can be efficiently set to be different depending on the relative rotation direction.

Figure 13:
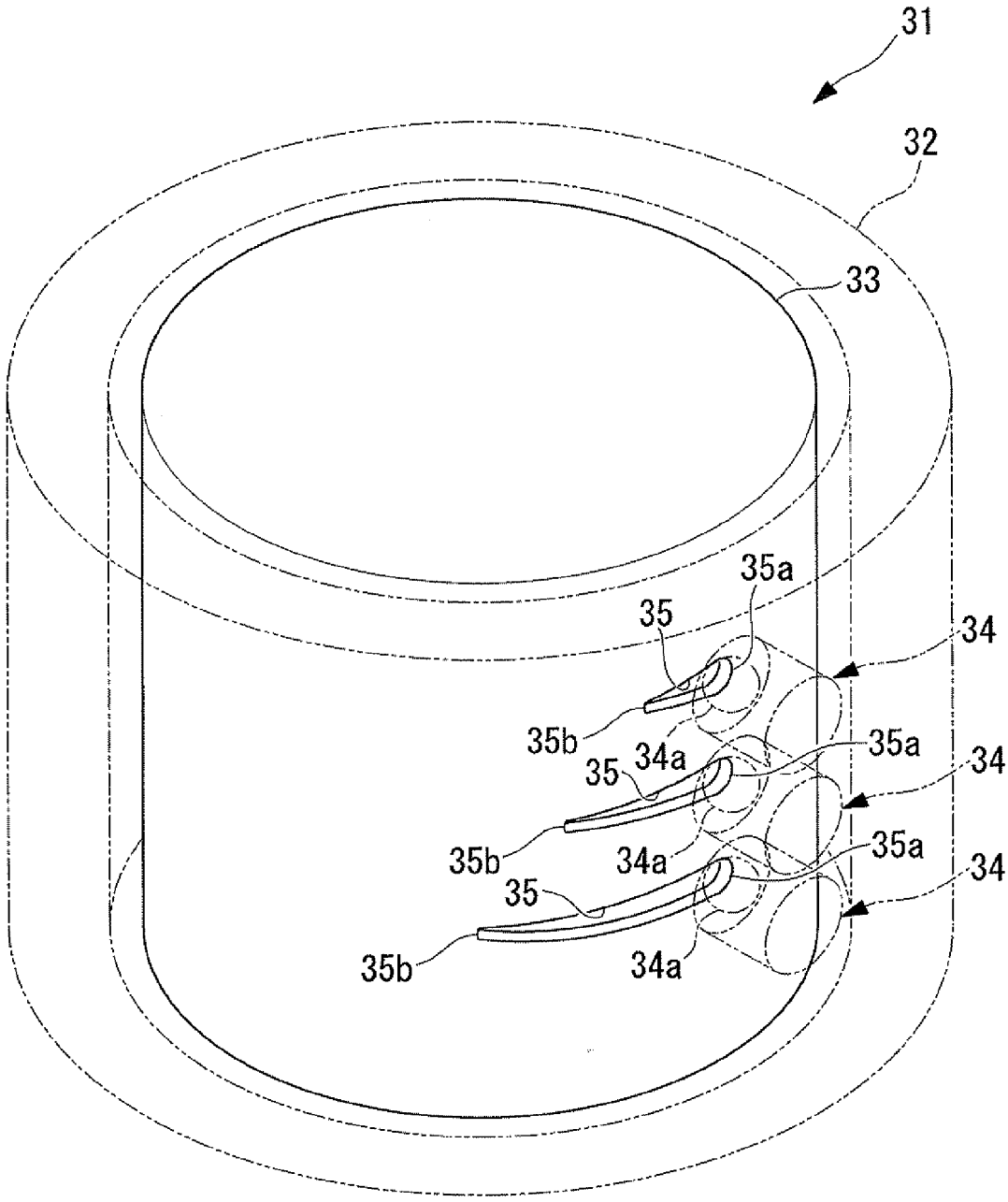
FIG. 13 is a perspective view of a second modification of the latching mechanism shown in FIG. 9.

As shown in the Modified Example in FIG. 13, the width of the depressed portions 35 in the direction intersecting with the relative rotation direction, i.e., the width in the axial direction of the depressed portions 35, may gradually changed such that the widths differ at the end sections 35*a* and 35*b* of the depressed portions 35. In this way, since the engagement of the ball portions 34*a* of the press-fit plungers 34 constituting the protruding portions 34 and the depressed portions 35 becomes loose at the end sections 35*b* of the depressed portions 35 with the smaller width, similar to the above-described case, the latching force can be set to be different at the end sections 35*a* and 35*b* of the depressed portions 35.

Figure 14:
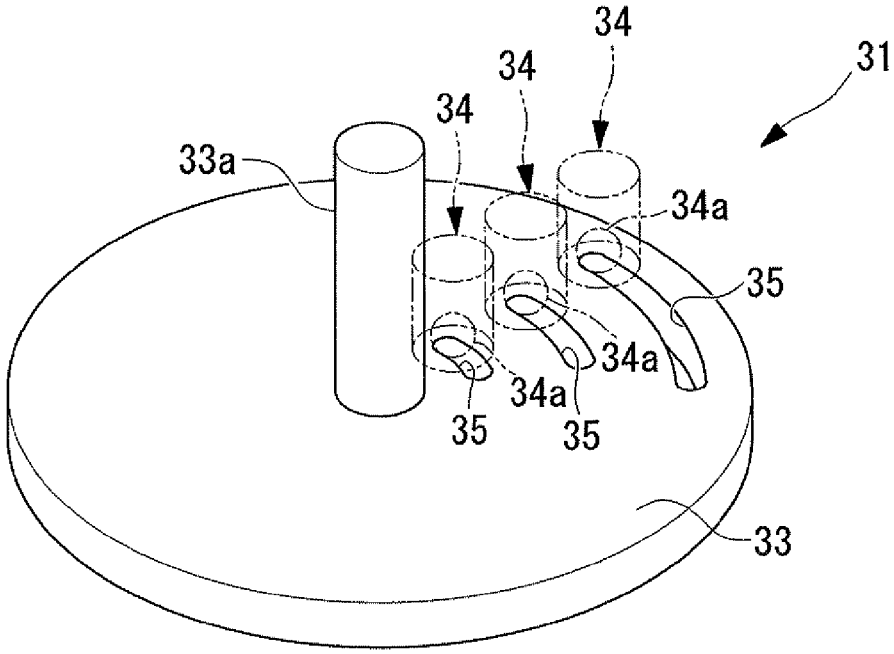
FIG. 14 is a perspective view of a third modification of the latching mechanism shown in FIG. 9.
Figure 15:
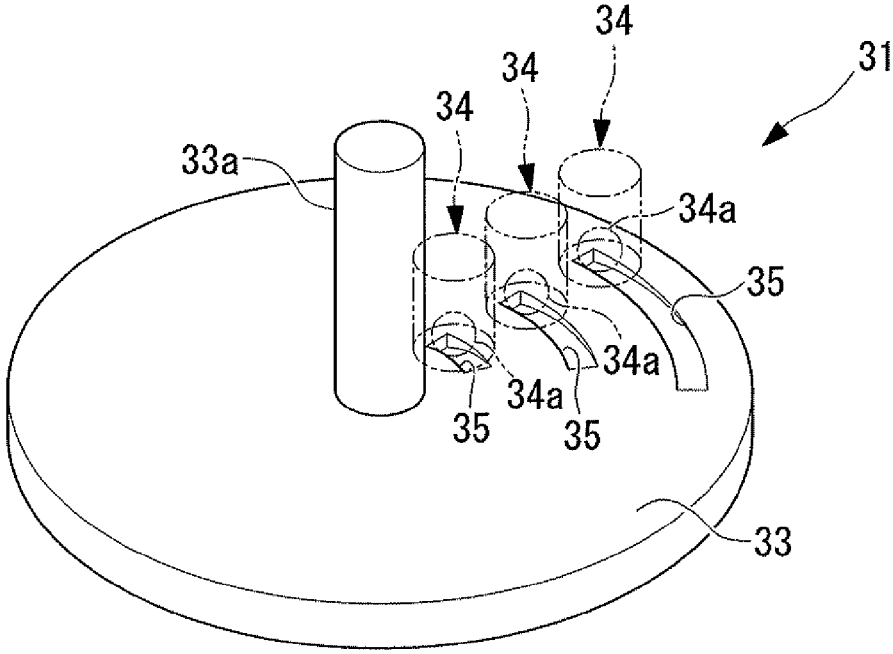
FIG. 15 is a perspective view of a fourth modification of the latching mechanism shown in FIG. 9.
Figure 16:
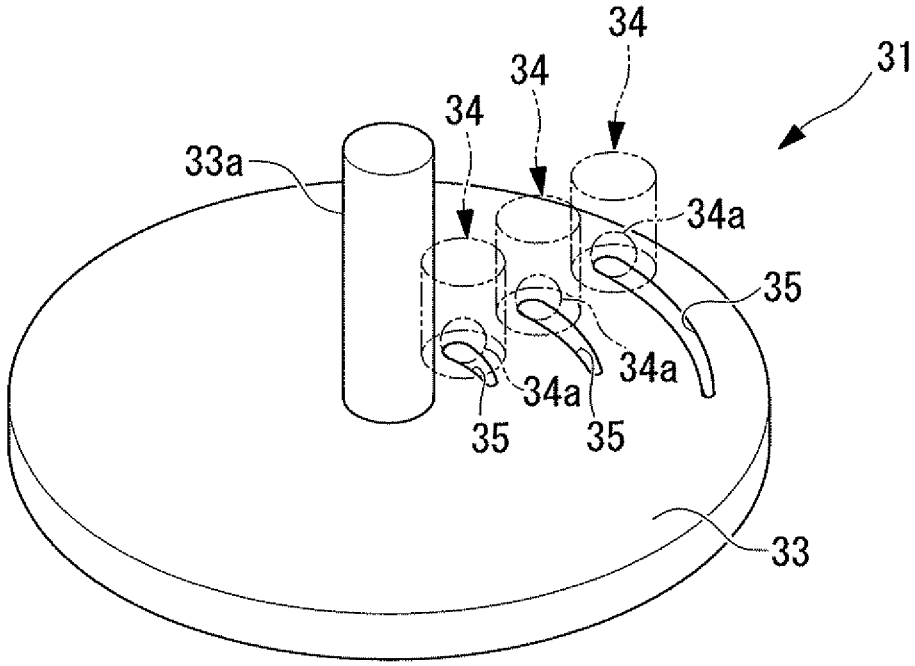
FIG. 16 is a perspective view of a fifth modification of the latching mechanism shown in FIG. 9.

With the latching mechanism 31 according to the second embodiment, the depressed portions 35 and the protruding portions 34 that are engaged with each other are provided on the surfaces where the outer member 32, which is the first member, and the inner member 33, which is the second member, face each other in the radial direction. Instead, however, as shown in the Modified Examples in FIGS. 14 to 16, the protruding portions 34 and the depressed portions 35 may oppose each other in the axial direction. In such a case, the depressed portions 35 may be constituted of a plurality of arc-shape grooves formed at predetermined intervals in the radial direction, and the protruding portions 34 corresponding to the depressed portions 35 may also be formed at predetermined intervals in the radial direction. FIG. 14 illustrates depressed portions 35 shaped as elongated holes, having the same depth and width; FIG. 15 illustrates depressed portions 35 having variable depths; and FIG. 16 illustrates depressed portions 35 having variable widths in the radial direction. In the drawings, reference numeral 33*a* represents the rotational axis of the second member 33, and the first member is not shown.

Figure 17:
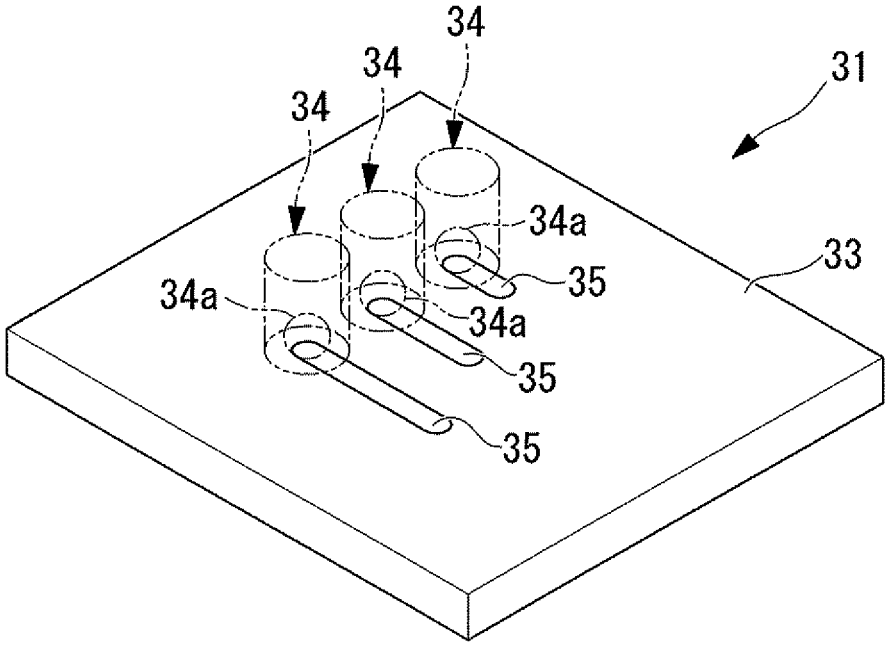
FIG. 17 is a perspective view of a sixth modification of the latching mechanism shown in FIG. 9.
Figure 18:
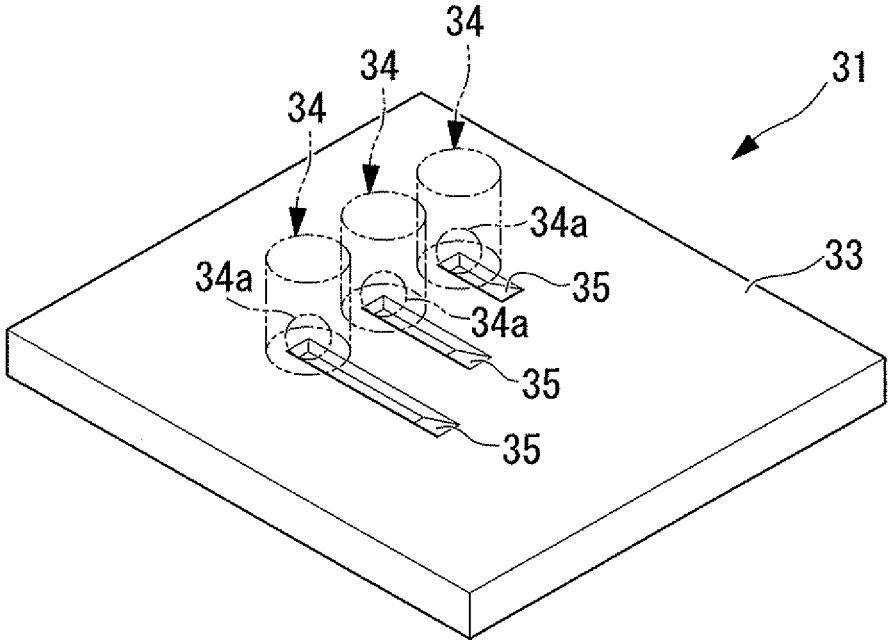
FIG. 18 is a perspective view of a seventh modification of the latching mechanism shown in FIG. 9.
Figure 19:
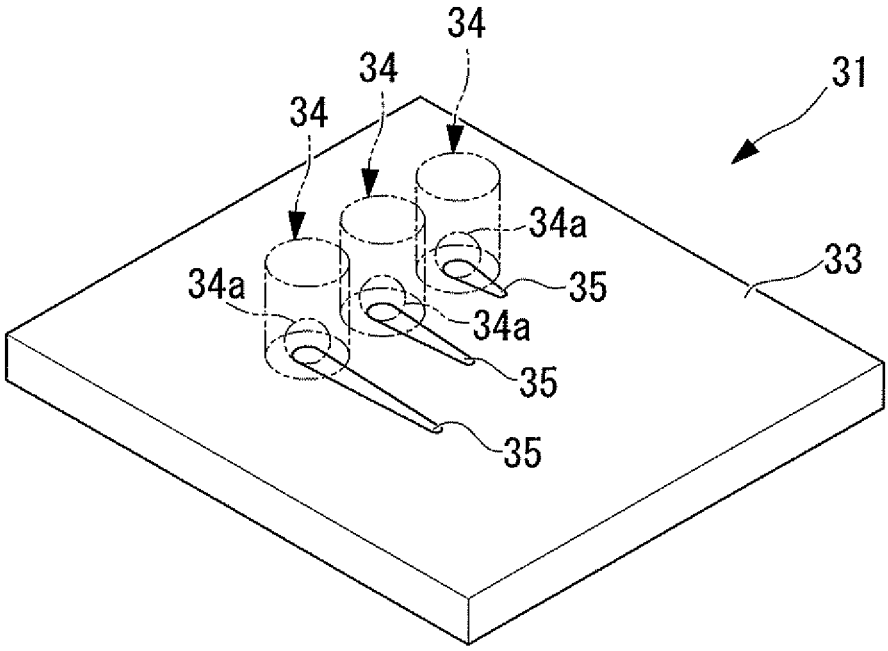
FIG. 19 is a perspective view of an eighth modification of the latching mechanism shown in FIG. 9.

With the latching mechanism 31 according to the second embodiment, the first member 32 and the second member 33 are disposed in a manner such that they are rotatable relative to each other. Instead, however, as shown in the Modified Examples in FIGS. 17 to 19, the latching mechanism 31 may be interposed between a first member and a second member 33 that are translated relative to each other. FIG. 17 illustrates depressed portions 35 shaped as elongated holes, having the same depth and width; FIG. 18 illustrates depressed portions 35 having variable depths; and FIG. 19 illustrates depressed portions 35 having variable widths in the radial direction.

The latching mechanism 31 may be employed in a sliding door, which has a disadvantage in that a person may be caught between the door when it slams shut because of its heavy weight. In this way, when the door is opened, it can be opened with a small force, whereas, when the door is closed, it can be temporarily latched with a large latching force, and then the latching can be disengaged by applying a larger force.

In the above-described second embodiment and the modifications thereof, the press-fit plungers 34 are provided as examples of the protruding portions 34 that are engaged with the depressed portions 35. However, the present invention is not limited thereto. Furthermore, the ball portions 34*a* of the press-fit plungers 34 are constituted of spherical bodies. However, the present invention is not limited thereto, and the ball portion 34*a* may be constituted of any other members that are hemispherical or that have spherical surfaces. Furthermore, instead of spherical surfaces, rollers may be provided.

The invention claimed is:

1. An opening-and-closing mechanism comprising:

a first supporting member and a second supporting member disposed so as to be capable of relative rotation around a rotary axis;

a plurality of protruding portions provided on the first supporting member; and a plurality of depressed portions provided on the second supporting member and engaged with the plurality of protruding portions, wherein at least some of the plurality of depressed portions have different lengths in a circumferential direction centered at the rotary axis and different positions in a radial direction than others of the plurality of depressed portions;

wherein, when the first supporting member and the second supporting member are in a plurality of predetermined relative alignments, a predetermined amount of the plurality of protruding portions and the same amount of the plurality of depressed portions are engaged;

wherein forces required for disengaging the protruding portions and the depressed portions by rotating at least one of the first supporting member and second supporting member differ in a first rotation direction and a second rotation direction; and wherein the positions and the lengths in the circumferential direction of the depressed portions are set so that the number of protruding portions and depressed portions that are simultaneously disengaged differs depending on the relative rotating direction.

2. The opening-and-closing mechanism according to claim 1, wherein the depressed portions are arc-shaped, extending in the circumferential direction centered at the rotary axis.

3. The opening-and-closing mechanism according to claim 1, wherein the depressed portions extend in the circumferential direction centered at the rotary axis, and the widths in the radial direction differ at both ends in the circumferential direction.

4. The opening-and-closing mechanism according to claim 1, wherein the depths of the depressed portions differ at both ends in the circumferential direction centered at the rotary axis.

5. The opening-and-closing mechanism according to claim 1, further comprising:

a connecting member for connecting the first supporting member and the second supporting member in a rotatable manner around the rotary axis, wherein a pushing force acting upon a contact section of the first supporting member and the second supporting member is controlled by the connecting member.

6. The opening-and-closing mechanism according to claim 1, further comprising:

a sliding member for controlling a coefficient of friction between the first supporting member and the second supporting member.

7. The opening-and-closing mechanism according to claim 1, further comprising:

a stopper portion for limiting the range of relative alignment adopted by the first supporting member and the second supporting member, the stopper portion being provided on at least one of the first supporting member and the second supporting member.

8. A latching mechanism which is interposed between a first member and a second member that are moved relatively and which latches the relative movement of the first member and the second member, the latching mechanism comprising:

a plurality of protruding portions provided on the first member; and a plurality of depressed portions provided on the second member and engaged with the protruding portions, wherein at least some of the plurality of depressed portions have different lengths in the relative movement direction and positions in a direction intersecting the relative movement direction than others of the plurality of depressed portions;

wherein a force required for disengaging the protruding portions and the depressed portions differs depending on the relative movement direction;

wherein the positions and lengths of the depressed portions are set such that the number of protruding portions and depressed portions simultaneously disengaged differs depending on the relative movement direction.

9. The latching mechanism according to claim 8, wherein a plurality of sets of depressed portions comprising a plurality of depressed portions that are simultaneously engaged with the plurality of protruding portions are provided in the relative movement direction of the first member and the second member, with spaces provided between the sets.

10. The latching mechanism according to claim 8, wherein the depressed portions extend in the relative movement direction of the first member and the second member.

11. The latching mechanism according to claim 8, wherein the depressed portions extend in the relative movement direction of the first member and the second member, and wherein the widths of the depressed portion in a direction intersecting with the relative movement direction differ at both ends in the relative movement direction.

12. The latching mechanism according to claim 8, wherein the depressed portions extend in the relative movement direction of the first member and the second member, and wherein the depths of the depressed portions differ at both ends in the relative movement direction.

13. The latching mechanism according to claim 8, wherein each of the protruding portions includes a spherical body having a spherical surface that engages with one of the depressed portions and a pushing member that pushes the spherical body toward the second member.

* * * * *